US007716878B1

(12) United States Patent
Altman

(10) Patent No.: US 7,716,878 B1
(45) Date of Patent: May 18, 2010

(54) DECORATIVE TOMBSTONE COVER

(76) Inventor: Denise C. Altman, 4741 Riverbirch Dr., Orangeburg, SC (US) 29118

( * ) Notice: Subject to any disclaimer, the term of this patent is extended or adjusted under 35 U.S.C. 154(b) by 64 days.

(21) Appl. No.: 11/954,834

(22) Filed: Dec. 12, 2007

(51) Int. Cl.
*E01F 9/011* (2006.01)
*E04H 13/00* (2006.01)

(52) U.S. Cl. ..... 52/103; 52/3; 40/124.5

(58) Field of Classification Search ..... 52/103, 52/38, 4, 244, 3, 300, DIG. 14; 40/124.5, 40/124.2
See application file for complete search history.

(56) References Cited

U.S. PATENT DOCUMENTS

| | | | | |
|---|---|---|---|---|
| 2,013,377 | A | 9/1935 | Debs | 40/124.5 |
| 2,124,143 | A | 7/1938 | Long | 40/124.5 |
| D122,656 | S | 9/1940 | Adams | |
| 3,938,570 | A * | 2/1976 | Stewart | 150/160 |
| 4,304,076 | A | 12/1981 | Splendora | 52/104 |
| 4,538,385 | A * | 9/1985 | Kandarian | 150/154 |
| 5,220,950 | A | 6/1993 | Cordasco | 150/159 |
| 5,864,972 | A | 2/1999 | Gamache | 40/124.5 |
| D440,144 | S * | 4/2001 | Todd | D8/354 |
| 6,418,676 | B1 | 7/2002 | Olsen et al. | 52/103 |
| 6,561,696 | B1 * | 5/2003 | Rusnak et al. | 383/75 |
| 7,181,815 | B2 | 2/2007 | Hunter | 27/30 |
| 2005/0263227 | A1 * | 12/2005 | Connolly | 150/154 |
| 2007/0266643 | A1 * | 11/2007 | Cowvins | 52/3 |

* cited by examiner

*Primary Examiner*—David Dunn
*Assistant Examiner*—Benjamin Pevarski
(74) *Attorney, Agent, or Firm*—Joseph T. Guy; Nexsen Pruet, LLC

(57) ABSTRACT

A tombstone cover is described for the display of indicia. The cover has a member made from a flexible material adapted for disposal over the tombstone and a cinch. The member also has a front; a top; opposing sides; and a back. At least 50 percent of a height of the tombstone remains uncovered by the member.

7 Claims, 2 Drawing Sheets

DECORATIVE TOMBSTONE COVER

BACKGROUND

The present invention is related to a decorative cover for a tombstone. More particularly, the present invention is related to a cover for adorning a tombstone with a decorative symbol or message which does not obscure the information thereon.

Graveside markers have been used throughout most of recorded history. They range from simple markers with no indicia to very large ornate stones with information such as the name of the deceased, birth and death dates, favorite sayings or verses, decorative images and the like. As is well known the marker, also referred to as a tombstone, is not easily altered and certainly not intended to be altered. Alterations require a very elaborate process and typically the only time a grave marker is altered is upon the occasion of the death of a spouse or an individual sharing the stone over common graves.

Loved ones have long felt an emotional desire to adorn gravesites and tombstones with materials indicative of a season or special occasion. There is currently no way to easily adorn a tombstone for such occasions. There are teachings of covers which can contain images yet these obscure the markings on the tombstone which defeats the purpose of the stone. There has been a long felt need for a decorative tombstone cover which can be placed on a tombstone for a special occasion and removed without permanently altering the stone or obscuring the information permanently etched or printed thereon.

SUMMARY

It is an object of the present invention to provide a decorative tombstone cover which can be adorned with images and which does not block the information on the tombstone.

It is another object of the present invention to provide a decorative tombstone cover which has a cinch system to prohibit the cover from being dislodged by wind.

These and other advantages, as will be realized, are provided in a cover for a tombstone having a member made from a flexible material adapted for disposal over the tombstone wherein the member has a cinch. The member also has a front; a top; opposing sides; and a back. At least 50 percent of a height of the tombstone remains uncovered by the member.

Yet another embodiment is provided in a covered tombstone. Provided is a tombstone and a cover. The cover has a front, a top, a strap attached to the front and circumferentially around the tombstone and at least one vertical strap between the strap and the top. At least 50 percent of a height of the tombstone remains uncovered by the member.

Yet another embodiment is provided in a cover for a tombstone. The cover has a member made from a flexible material adapted for disposal over the tombstone wherein the member further comprises a cinch. The member has a front, top, opposing sides a back. A cinch is integral to the member wherein the cinch contracts a portion of the member inward toward the tombstone and wherein the cinch comprises at least one element selected from the group consisting of an elastic element and a clasp.

DETAILED DESCRIPTION

The present invention is directed to a decorative tombstone cover which does not obscure the markings permanently etched therein. More specifically, the present invention is directed to a rectangular standing tombstone. The invention will be described with reference to the figures forming an integral portion of the present disclosure. Throughout the various figures common elements will be numbered accordingly.

Figure 1:
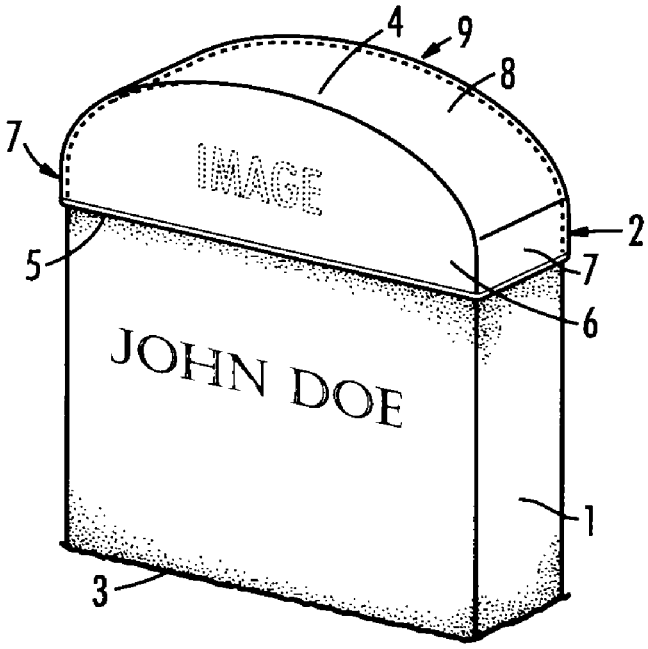
FIG. 1 is a schematic front perspective view of an embodiment of the present invention.

An embodiment of the present invention is illustrated in FIG. 1. In FIG. 1, the tombstone, 1, is a typically a monolith type structure such as a rectangle, an arch, or an ornate design. The shape of the tombstone is not particularly limited herein. The tombstone typically has images etched therein or painted thereon to indicate the name of the deceased, birth date, date of death, and other indications commemorating the life of the deceased or some aspect thereof.

The inventive cover, 2, encases the top portion of the tombstone only. It is most preferred that at least 50 percent of the height of the face of the tombstone remains uncovered as measured from the base, 3, to the highest covered extent, 4. More preferably at least 75% of the height of the tombstone remains uncovered and even more preferably at least 80% of the height of the tombstone remains uncovered. If more than 95% of the height of the tombstone remains uncovered there is insufficient contact between the cover and the tombstone thereby making it difficult for the cover to remain in place.

A cinch, 5, preferably at the lowest extent of the inventive cover, draws in against the tombstone thereby securing the cover by resistance fit. It is preferred that the cover be substantially shaped like the top of the tombstone and bound by five sides including a front, 6, two sides, 7, top, 8, and back, 9. It is most preferable to include an image on at least the front such as Merry Christmas, Happy Easter, Happy Birthday, or any other message or image suitable for the occasion and desires of the person placing the cover over the tombstone. Messages may also be on the top, sides or back if so desired.

Figure 2:
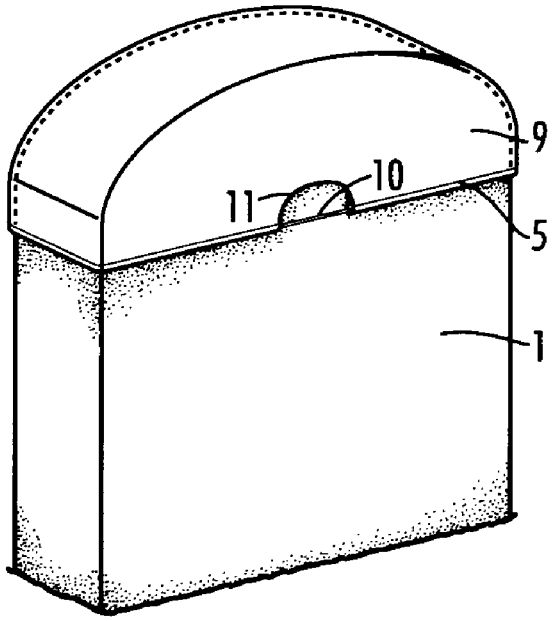
FIG. 2 is a rear view of an embodiment of the present invention.

A schematic rear view of the embodiment of FIG. 1 is illustrated in FIG. 2. In FIG. 2, the cinch, 5, comprises an elastic member, 10, in a recess, 11, of the back, 9. The recess allows the cinch to be pulled tight on the tombstone by the elastic member without buckling of the tombstone cover. It is preferred that the cinch, and associated elastic member, completely circle the tombstone but this is not necessary to demonstrate the present invention.

Figure 3:
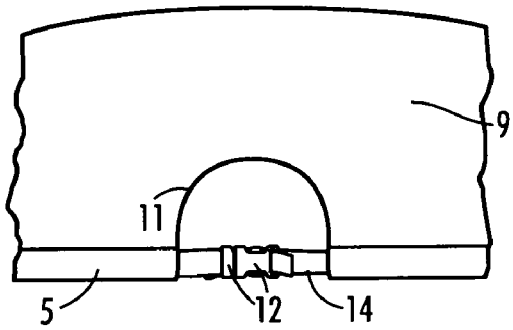
FIG. 3 is a partial schematic view of an embodiment of the present invention.

Another embodiment of the present invention is illustrated in partial cutaway schematic view in FIG. 3. In FIG. 3 the cinch comprises mating clasp which can be fastened together. A band, 14, preferably an adjustable band, can be pulled tight thereby securing the cover to the tombstone.

Figure 4:
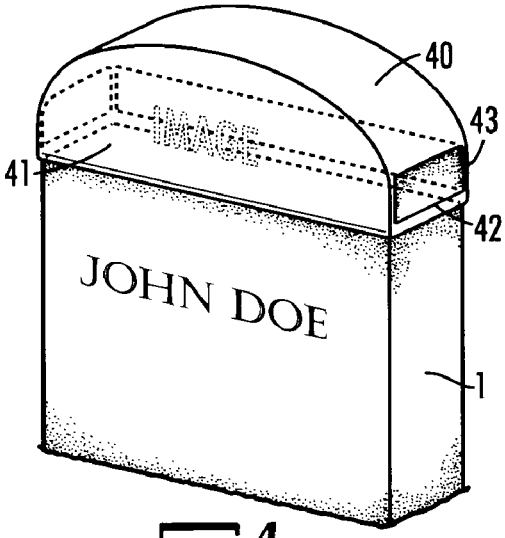
FIG. 4 is a schematic front perspective view of another embodiment of the present invention.
Figure 5:
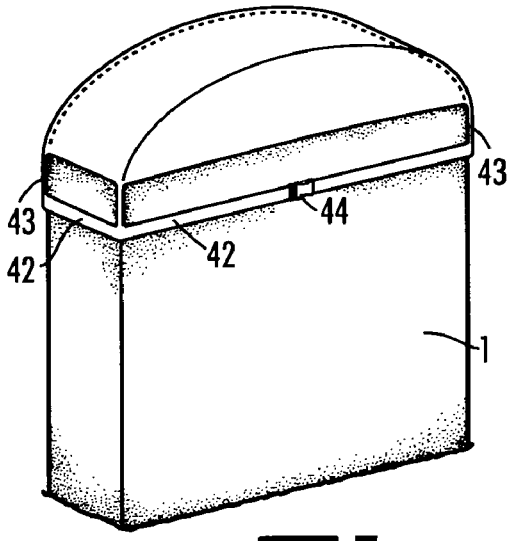
FIG. 5 is a rear view of another embodiment of the present invention.

Another embodiment of the present invention is illustrated in front perspective schematic view in FIG. 4. and rear view in FIG. 5. The cover comprises a top, 40, and front, 41, as described above. The sides and back are formed by circumferential straps, 42, and vertical straps, 43. With this embodiment the sides and back of the tombstone are not obscured except for the strap portion which is a small percentage of the surface area. It would be apparent that the cover could be rotated such that the front is on the rear of the tombstone and the front has only a circumferential strap there across. The circumferential strap, or vertical straps, may be elastic or they may have an optional clasp, 44, which is fastened and the strap tightened.

The material of construction is preferably an opaque material which withstands environmental conditions, is flexible and which can be easily printed. A particularly preferred material is canvas due to the cost, availability, ease of printing and simplicity in preparation and particularly canvas which is treated to resist moisture.

The straps are most preferably an elastic strap or a woven strap. Both types are readily available from commercial sources.

The clasp is not particularly limited herein. Particularly preferred clasp include belt and buckle assemblies, snap insert assemblies, hoop and latch (VELCRO™) assemblies and the like.

The present invention is particularly advantageous since it does not interfere with the efforts of a grounds keeper. Flowers and other grave side adornments are prone to being blown about the property and have to be moved for mowing and the like. With the present invention the adornment is removed from the grass and remains on the tombstone thereby eliminating the necessity to relocate the adornment due to dislodgement or ground keeping activities.

The present invention has been described with particular reference to the preferred embodiments without limit thereto. One of skill in the art would readily realize additional embodiments which are not disclosed but which are within the meets and bounds of the invention as more specifically set forth in the claims appended hereto.

The invention claimed is:

1. A covered tombstone comprising;

a tombstone;

a cover comprising:

a front, a top, a strap attached to said front and circumferentially around said tombstone and at least one vertical strap between said strap and said top;

wherein at least 50 percent of a height of said tombstone remains uncovered by said cover.

2. The covered tombstone of claim 1 wherein at least 75 percent of a height of said tombstone remains uncovered by said cover.

3. The covered tombstone of claim 2 wherein at least 80 percent of said height of said tombstone remains uncovered by said cover.

4. The covered tombstone of claim 3 wherein no more than 95 percent of said height of said tombstone remains uncovered by said cover.

5. The covered tombstone of claim 1 wherein said strap further comprises a cinch.

6. The covered tombstone of claim 5 wherein said strap comprises an elastic member.

7. The covered tombstone of claim 5 wherein said cover further comprises a clasp.

* * * * *